US005489252A

United States Patent [19]

May

[11] Patent Number: 5,489,252

[45] Date of Patent: Feb. 6, 1996

[54] CLOSURE ARRANGEMENT HAVING A PEELABLE SEAL

[75] Inventor: Timothy J. May, Greenville, Wis.

[73] Assignee: Reynolds Consumer Products Inc., Appleton, Wis.

[21] Appl. No.: 499,620

[22] Filed: Jul. 7, 1995

Related U.S. Application Data

[62] Division of Ser. No. 225,864, Apr. 11, 1994, Pat. No. 5,470,156.

[51] Int. Cl.[6] ..... B65D 33/16; B65D 33/24

[52] U.S. Cl. ..... 383/210; 24/587; 156/66; 383/61; 383/63; 493/214

[58] Field of Search ..... 383/210, 211, 383/61, 63, 65; 493/214; 156/66; 24/587

[56] References Cited

U.S. PATENT DOCUMENTS

| | | | |
|---|---|---|---|
| 3,339,606 | 9/1967 | Kugler | 383/211 |
| 3,613,874 | 10/1971 | Miller | 383/211 |
| 4,736,451 | 4/1988 | Ausnit | 383/65 |
| 4,925,316 | 5/1990 | Van Erden et al. | 383/63 |

*Primary Examiner*—Stephen P. Garbe
*Attorney, Agent, or Firm*—Alan T. McDonald

[57] ABSTRACT

In one embodiment, a closure arrangement for a polymeric bag having a pair of opposing films comprises a wide base strip, a pair of narrow heat-resistant strips composed of heat-resistant material, and a T-shaped peelable strip composed of peelable material. The base strip has opposing inner and outer surfaces, and the outer surface of the base strip is adapted for attachment to one of the pair of opposing films of the polymeric bag. The-pair of heat-resistant strips are attached to the inner surface of the base strip, and are positioned generally parallel to each other and spaced from each other so as to form a gap therebetween. The peelable strip includes a top portion having opposing first and second surfaces and a stem portion extending perpendicular to the first surface of the top portion. The stem portion extends into the gap between the pair of heat-resistant strips and is attached to the inner surface of the base strip. The top portion is positioned generally parallel to the pair of heat-resistant strips with the first surface opposing the pair of heat-resistant strips. Various other closure arrangements are also disclosed.

12 Claims, 3 Drawing Sheets

CLOSURE ARRANGEMENT HAVING A PEELABLE SEAL

This application is a division of Ser. No. 08/225,864 filed Apr. 11, 1994 now U.S. Pat. No. 5,470,156.

FIELD OF THE INVENTION

The present invention generally relates to closure arrangements for polymeric (plastic) bags and, more particularly, relates to a closure arrangement having a peelable seal which provides a consistent hermetic seal, which allows for quick and easy access to the contents of the bag, and which is relatively insusceptible to small manufacturing variations.

DESCRIPTION OF THE PRIOR ART

In many consumer packaging applications, it is important to prevent air or water or the like from passing out of or into a package containing certain products. This is particularly true with respect to meat packages, cheese packages, and the like, for which the contained product must be kept in a constant environment to prevent spoilage. In order to preserve the product contained within such a package, the periphery of the package must be hermetically sealed. Hermetic seals can be provided by both permanent seals and temporary seals known as peelable seals. Peelable seals are capable of providing a hermetic seal and, at the same time, providing a consumer with access to the contents of a package. A consumer breaks a peelable seal of a package by first grabbing onto opposing film faces to which peelable seal materials are adhered and then pulling the film faces apart. To provide a peelable seal on a package with a reclosable zipper, the package typically uses permanent seals at its side edges and bottom edge and a peelable seal above or below the reclosable zipper at the mouth end of the package. In addition, the peelable seal may be arranged on either the flange/base portions of the zipper or on the packaging film adjacent to the flange portions.

Typically one sealing station is used to seal all the edges of a package and, at the same time, make a peelable seal from a strip of peelable materials. The sealing station has a set of seal bars, protruding from a sealing head, which press the package edges and the peelable strip against a resilient backing such as rubber to form both the permanent edge seals and the peelable seal. The strength of the seals is determined by the temperature, pressure, and dwell time of the seal bars.

The above process is slightly modified when a reclosable zipper is inserted at the mouth end of the package between the top and bottom films of the package, and a peelable seal is to be located above or below the zipper. In that situation, the package typically reaches the sealing station with the zipper adhered to only the bottom film. The sealing station has a seal bar for (1) adhering the top film to a flange portion of the zipper and (2) creating the peelable seal.

There are a couple of typical approaches for forming peelable seals on reclosable packages having a top and bottom film. One typical approach adheres a multilayered film to each of the opposing inner surfaces of the packaging film (or zipper flange portions) along the length of the mouth end of the package. This results in a first multilayered film on the inner surface of the top film and a second multilayered film on the inner surface of the bottom film. A peelable seal is formed by heat sealing the first and second multilayered films to one another. When a consumer breaks the peelable seal, one or more layers of the second multilayered film will disengage from the other layers of the second multilayered film and remain adhered to the first multilayered film. As a result, the first multilayered film will include at least one additional layer when the peelable seal is broken. The above layer disengagement upon breaking the peelable seal is accomplished by using film layers composed of different polymeric materials and by exploiting the varying bond strengths between the layers.

Another typical approach adheres a layer of film to each of the opposing inner surfaces of the packaging film (or zipper flange portions) and introduces contaminants to one or both of the film layers. When the peelable seal is formed by heat sealing the layers to one another, the bond between them is weak due to the surface contamination. Breaking the peelable seal detaches the layers from one another.

The foregoing approaches for forming peelable seals suffer from several drawbacks. One drawback is that the peelable seals are highly susceptible to small variations which might occur during manufacture, i.e., the peelable seals have low manufacturing tolerances. For example, slight variations in the temperature, pressure, or dwell time of the seal bar forming the peelable seal might create a peelable seal which is either too weak or too strong. An excessively weak peelable seal might not provide a hermetic seal, while an excessively strong peelable seal might be difficult for a consumer to break. Thus, the low manufacturing tolerances of the peelable seals leads to unpredictability and nonuniformity in the bond strength provided by the peelable seals.

Since the peelable seals are highly susceptible to small manufacturing variations, a related drawback of the foregoing approaches for forming peelable seals is that the peelable seals do not consistently break in the same manner from bag to bag. For instance, breaking a peelable seal on one bag might detach only one layer of the multilayered film, while breaking a peelable seal on another bag might detach more than one layer of the multilayered film.

Consequently, a need exists for a closure arrangement for a polymeric bag which overcomes the aforementioned shortcomings associated with existing peelable seals.

SUMMARY OF THE INVENTION

Accordingly, an object of the present invention is to provide a closure arrangement for a polymeric bag having a peelable seal which provides a hermetic seal and, at the same time, can be quickly and easily broken.

Another object of the present invention is to provide a closure arrangement having a peelable seal which is relatively insusceptible to small manufacturing variations.

Yet another object of the present invention is to provide a closure arrangement having a peelable seal which is consistent in strength from one bag to the next and which breaks consistently from one bag to the next.

In one particular embodiment, these and other objects are realized by providing a closure arrangement for a polymeric bag having a pair of opposing films comprising a wide base strip, a pair of narrow heat-resistant strips composed of heat-resistant material, and a T-shaped peelable strip composed of peelable material. The base strip has opposing inner and outer surfaces, and the outer surface of the base strip is adapted for attachment to one of the pair of opposing films of the polymeric bag. The pair of heat-resistant strips are attached to the inner surface of the base strip, and are positioned generally parallel to each other and spaced from each other so as to form a gap therebetween. The peelable strip includes a top portion having opposing first and second surfaces and a stem portion extending perpendicular to the first surface of the top portion. The stem portion extends into the gap between the pair of heat-resistant strips and is attached to the inner surface of the base strip. The top portion is positioned generally parallel to the pair of heat-resistant strips with the first surface opposing the pair of heat-resistant strips. The second surface of the top portion is adapted for attachment to the other of the pair of opposing films of the polymeric bag.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
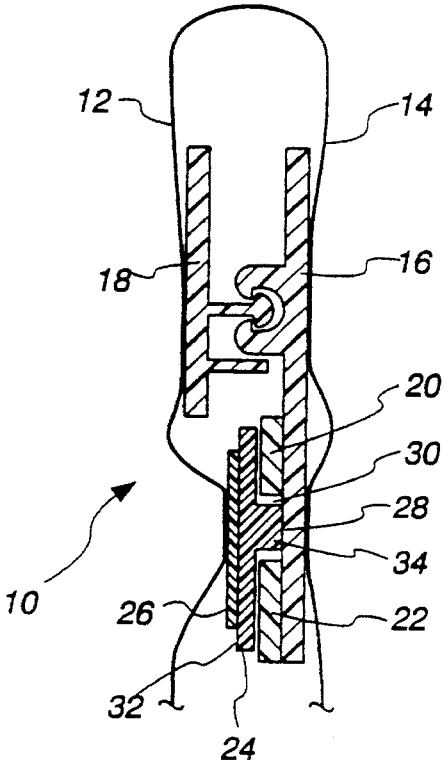
FIG. 1 is a sectional view of a closure arrangement of one embodiment of the present invention, showing a peelable seal prior to being broken.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 2:
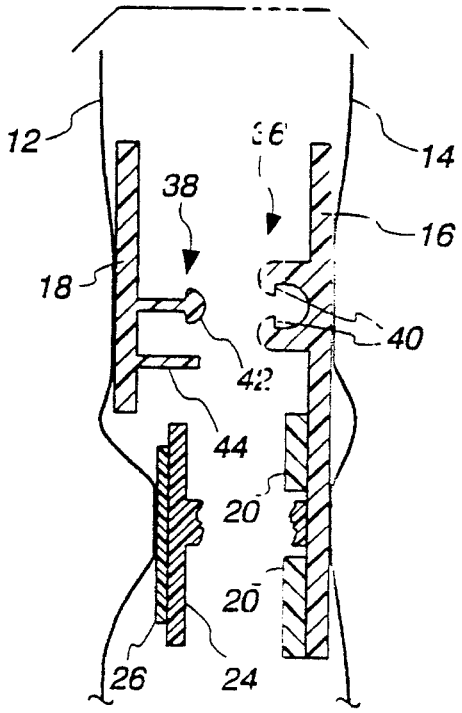
FIG. 2 is a sectional view of the closure arrangement in FIG. 1, showing the peelable seal after being broken.

Turning now to the drawings, FIGS. 1 and 2 illustrate a sectional view of a closure arrangement 10 for a reclosable bag having a top film 12 and a bottom film 14. The closure arrangement 10 includes a pair of flat base strips 16, 18, a pair of flat identical non-sealable strips 20, 22, a T-shaped peelable strip 24, and a sealant strip 26. The strips 16–26 are disposed at the mouth of the reclosable bag and extend along the length of the bag mouth. The top film 12 is heat-fused to both the base strip 18 and the sealant strip 26 and the bottom film 14 is heat-fused to the base strip 16 at preselected locations.

The strips 16–26 provide the closure arrangement 10 with a peelable seal at the location 28. The non-sealable strips 20, 22 are composed of a non-sealable (i.e., heat-resistant) material and are attached to the inner surface of the base strip 16. The non-sealable strips 20, 22 are positioned parallel to each other and are spaced from each other so as to form a gap 30 therebetween.

The T-shaped peelable strip 24 is composed of peelable material and includes a top portion 32 and a stem portion 34. The stem portion 34 is integrally formed with the top portion 32 and extends perpendicular to the center of the top portion 32. The stem portion 34 projects into the gap 30 between the non-sealable strips 20, 22, and the base of the stem portion 34 is attached to the inner surface of the base strip 16. The vertical dimension (as viewed in FIGS. 1 and 2) of the stem portion 34 is only slightly less than the size of the gap 30 so that the stem portion 34 occupies a substantial portion of the gap 30. Moreover, the horizontal dimension (as viewed in FIGS. 1 and 2) of the stem portion 34 is only slightly greater than the horizontal dimension of the non-sealable strips 20, 22 so that the inner (right) surface of the top portion 32 is immediately adjacent, but not attached, to the non-sealable strips 20, 22. The vertical dimension of the top portion 32 is slightly less than the combined vertical dimensions of the non-sealable strips 20, 22 and the gap 30 so that the top portion 32 is still separated from the base strip 16 at its extreme ends by the non-sealable strips 20, 22. The non-sealable strips 20, 22 ensure that the top portion 32 of the peelable strip 32 does not bond to the inner surface of the base strip 16 during production.

The sealant strip 26 is composed of low-temperature sealant material and is firmly attached to the outer (left) surface of the top portion 32 of the peelable strip 32. The vertical dimension of the sealant strip 26 is slightly less than the vertical dimension of the top portion 32. Since the sealant strip 26 bonds readily to other materials at low temperatures, the sealant strip 26 acts as a bridge for attaching the top film 12 to the top portion 32 of the peelable strip 24. Alternatively, the top film 12 may be heat-fused directly to the top portion 32 of the peelable strip 24 by use of higher temperatures, greater pressure, and/or greater dwell time of the seal bar during the heat sealing process.

To provide the closure arrangement 10 with a reclosable zipper, the base strips 16, 18 have integrally formed therewith respective female and male closure profiles 36, 38. The female closure profile 36 extends inwardly from the inner surface of the base strip 16 and includes a pair of flexible locking members 40 with hooks at the ends thereof. The male closure profile 38 extends inwardly from the inner surface of the base strip 18 and includes a single locking member 42 with an expanded head. The pair of locking members 40 are disposed opposite the single locking member 42 and are spaced by a sufficient distance that the expanded head of the single locking member 42 is releasably engageable between the pair of locking members 40. More specifically, the pair of locking members 40 interlock with the locking member 42 in a snapping action caused by bringing the hooks of the pair of locking members 40 passed the expanded head of the locking member 42. To facilitate alignment of the pair of locking members 40 with the locking member 42 during reclosure, the male closure profile 38 is provided with a guide post 44 for guiding one of the pair of locking members 40 between the guide post 44 and the locking member 42.

The closure arrangement 10 is manufactured using conventional extrusion and heat sealing techniques. In particular, the base strips 16, 18, the closure profiles 36, 38, the non-sealable strips 20, 22, the peelable strip 24, and the sealant strip 26 are co-extruded through a die plate fed by a plurality of extruders. These extruders carry the different molten materials for forming the strips 16–26 and the closure profiles 36,38. As is well-known in the art, the die plate includes input ports, output ports, and channels connecting these input ports to output ports. The extruders feed the different molten materials to different input ports, and the channels are designed to configure the molten materials into the shapes of the strips 16–26 and the closure profiles 36, 38. The output ports are arranged such that the strips 16–26 and the closure profiles 36, 38 exit the die plate with the connections shown in FIG. 1. Since the base strip 18 and the closure profile 38 are separated from the base strip 16, the non-sealable strips 20, 22, the peelable strip 24, the sealant strip 26, and the closure profile 36, it should be apparent that these two separate sets of elements may be formed in separate extrusions using two different die plates.

After extruding the strips 16–26 and the closure profiles 36, 38, the top and bottom films 12, 14 are heat-fused using heated seal bars in the positions shown in FIG. 1. In particular, the top film 12 is heat-fused to the base strip 18 and the sealant strip 26, and the bottom film 14 is heat-fused to the base strip 16 at the illustrated positions. The vertical dimension (as viewed in FIG. 1) of the heat-fused positions is determined by the width of the seal bars applying pressure to the top and bottom films 12, 14.

Due to the interposition of the non-sealable strips 20, 22 between the top portion 32 of the peelable strip 24 and the base strip 16, the closure arrangement 10 accommodates wider seal bars for the above-mentioned heat sealing operations. If the seal bars transmit heat to the top portion 32 of the peelable strip 24, the non-sealable strips 20, 22 prevent the top portion 32 from fusing to the base strip 16 in response to this heat. The closure arrangement 10 is also relatively insusceptible to manufacturing variations. For example, the seal bar for fusing the top film 12 to the sealant strip 26 is preferably aligned with the stem portion 34 of the peelable strip 24, and, similarly, the seal bar for fusing the bottom film 14 to the lower portion of the base strip 16 is preferably aligned with the stem portion 34. If, however, these two seal bars are slightly misaligned relative to the stem portion 34, the non-sealable strips 20, 22 prevent the peelable strip 24 from forming any additional bonds to the base strip 16 than the bond formed between the stem portion 34 and the base strip 16.

As shown in FIG. 1, prior to initially opening a bag incorporating the closure arrangement 10, the peelable seal at the location 28 is intact, the closure profiles 36, 38 are interlocked with each other, and the top and bottom films 12, 14 are connected at the mouth end of the bag. The top and bottom films 12, 14 either are heat-fused together at the mouth end of the bag or are formed from a single piece of film. Since the peelable seal already provides a hermetic seal for the bag, the top and bottom films 12, 14 may alternatively be disconnected from each other at the mouth end.

To open the bag, the top and bottom films 12, 14 are separated from each other by cutting them apart. Next, the interlocked closure profiles 36, 38 are detached from each other by grabbing onto the top and bottom films 12, 14 and pulling them apart. Finally, the peelable seal at the location 28 is broken by continuing to pull the top and bottom films 12, 14 in opposite directions. FIG. 2 illustrates the location 28 of the broken peelable seal as being within stem portion 34. Alternatively, the location 28 may be at the junction between the stem portion 34 and the base strip 16 so that breaking the peelable seal ruptures the bond between the stem portion 34 and the base strip 16.

The strength of the peelable seal is determined by the composition of the peelable material forming the peelable strip 24 and the size of the stem portion 34 of the peelable strip 24. With respect to the size of the stem portion 34, the larger the vertical dimension (as viewed in FIGS. 1 and 2) of the stem portion 34, the stronger the peelable seal. As explained in detail below, these variables are preferably chosen such that the peelable seal has a strength ranging from two to six pounds per lineal inch.

Figure 3:
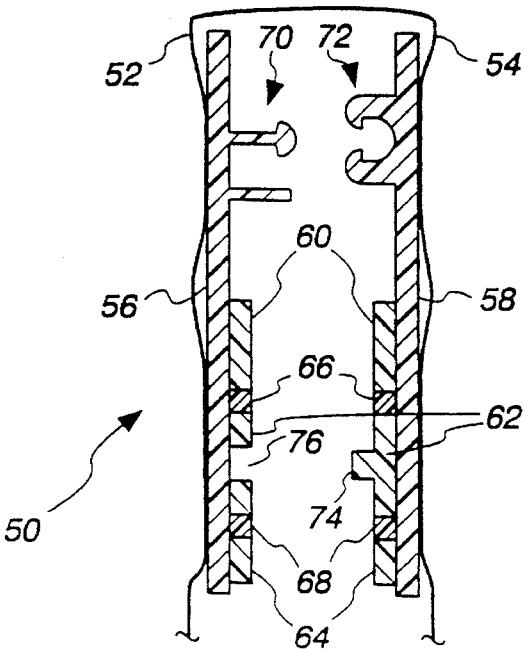
FIG. 3 is a sectional view of a closure arrangement of another embodiment of the present invention, showing a peelable seal prior to being formed (or after being broken)
Figure 4:
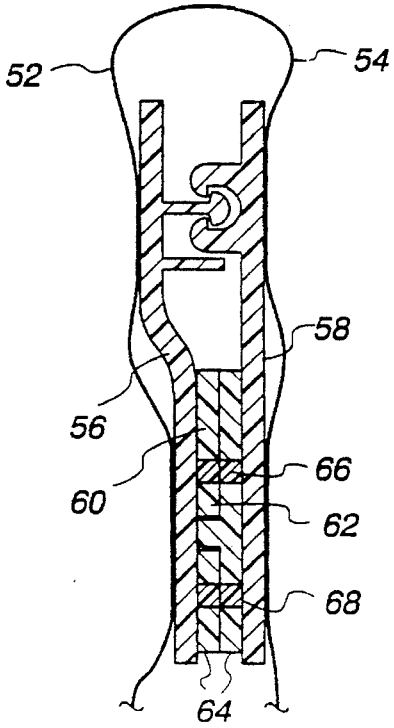
FIG. 4 is a sectional view of the closure arrangement in FIG. 3, showing the peelable seal after being formed and prior to being broken.

In accordance with another embodiment of the present invention, FIGS. 3 and 4 illustrate a closure arrangement 50 for a polymeric bag having a top film 52 and a bottom film 54. The closure arrangement 50 includes a pair of flat base strips 56, 58, three pairs of opposing non-sealable strips 60, 62, 64, and two pairs of opposing peelable bands 66, 68. The top film 52 is firmly attached to the outer surface of the base strip 56, and the bottom film is firmly attached to the outer surface of the base strip 58. If desired, the base strips 56, 58 may be provided with a reclosable zipper with associated male and female closure profiles 70, 72.

As shown in FIGS. 3 and 4, one of the non-sealable strips in each of the three pairs of non-sealable strips 60, 62, and 64 is attached to the inner surface of the base strip 56, and the other of the non-sealable strips in each of these three pairs is attached to the inner surface of the base strip 58. The two non-sealable strips in each pair are aligned with each other. Moreover, the pair of non-sealable strips 60 is separated from the pair of non-sealable strips 62 by the pair of peelable bands 66, and the pair of non-sealable strips 62 is separated from the pair of non-sealable strips 64 by the pair of peelable bands 68.

These pairs of peelable bands 66, 68 are attached to both the base strips and adjacent non-sealable strips. In particular, one of the pair of peelable bands 66 is attached to both the inner surface of the base strip 56 and adjacent non-sealable strips of the pairs of non-sealable strips 60, 62. Similarly, the other of the pair of peelable bands 66 is attached to both the inner surface of the base strip 58 and adjacent non-sealable strips of the pairs of non-sealable strips 60, 62. The pair of peelable bands 68 is attached to the base strips and adjacent non-sealable strips in the same manner.

As shown in FIG. 4, the peelable bands in each pair of peelable bands are attached to each other to form individual peelable seals therebetween. Therefore, one peelable seal is formed between the pair of peelable bands 66, and another peelable seal is formed between the pair of peelable bands 68. The closure arrangement 50 is designed to facilitate control of the strength of the combined peelable seal formed from these individual peelable seals. The strength of the combined peelable seal is determined by the width of the peelable bands, the number of pairs of peelable bands, and the material composition of the peelable bands. The wider the peelable bands, the stronger the individual peelable seals and, therefore, the stronger the combined peelable seal. Also, the greater the number of pairs of peelable bands, the stronger the combined peelable seal. Although FIGS. 3 and 4 illustrate the closure arrangement 50 as including two pairs of peelable bands, the closure arrangement 50 may be modified to include only one pair of peelable bands or more than two pairs of peelable bands. In the preferred embodiment, the combined peelable seal formed from the individual peelable seals has a strength ranging from two to six pounds per lineal inch.

Like the closure arrangement 10 in FIGS. 1 and 2, the closure arrangement 50 is manufactured using conventional extrusion and heat sealing techniques. The base strips 56, 58, the three pairs of non-sealable strips 60, 62, and 64, the two pairs of peelable bands 66, 68, and the closure profiles 70, 72 are preferably co-extruded with each other using a single die plate. If desired, however, separate die plates may be used to separately extrude the opposite sides of the closure arrangement 50.

After extruding the aforementioned elements of the closure arrangement 50, the top and bottom films 52, 54 are heat-fused to the respective base strips 56, 58 using heated seal bars. The heat from these seal bars penetrates through the closure arrangement 50 so as to simultaneously fuse the pair of peelable bands 66 to each other and fuse the pair of peelable bands 68 to each other. This heat fusion of opposing peelable bands creates the individual peelable seals. Since the pairs of non-sealable strips 60, 62, and 64 are composed of non-sealable material, they do not fuse to each other. The non-sealable strips render the closure arrangement 50 relatively insusceptible to small manufacturing variations by ensuring that no bonds are made aside from those described above.

To most efficiently use the peelable material provided by the pairs of peelable bands 66, 68 and achieve the desired strength for the combined peelable seal, it is preferable that each pair of peelable bands be properly aligned with each other during the heat sealing operation. In other words, the upper and lower ends of one peelable band should be aligned with the respective upper and lower ends of the opposing peelable band. To achieve this proper alignment, at least one of the pairs of non-sealable strips 60, 62, and 64 is provided with a projecting rib 74 on one non-sealable strip which mates with a gap 76 in the opposing non-sealable strip. In the preferred embodiment, this mating rib 74 and gap 76 are located on the central pair of non-sealable strips 62. While the rib 74 and gap 76 are illustrated as having the same horizontal dimension as the non-sealable strips so that the gap 76 essentially divides the associated non-sealable strip into two separate parts, it should be understood that the rib 74 and the gap 76 may be designed with smaller horizontal dimensions. Also, additional mating ribs and gaps may be provided on any of the three pairs of non-sealable strips 60, 62, and 64.

FIG. 4 illustrates the closure arrangement 50 after forming the individual peelable seals. To break the peelable seals, a user first cuts open the mouth end of the bag, grabs the top and bottom films 52, 54, and pulls the top and bottom films 52, 54 in opposite directions. After disengaging the interlocked closure profiles 70, 72 from each other, continued pulling of the bag films in opposite directions breaks the peelable seals. FIG. 3 illustrates the closure arrangement 50 after breaking the peelable seals.

Figure 5:
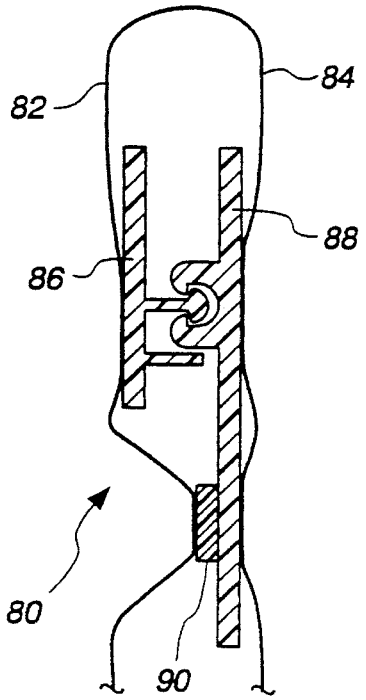
FIG. 5 is a sectional view of a closure arrangement of yet another embodiment of the present invention, showing a peelable seal prior to being broken.
Figure 6:
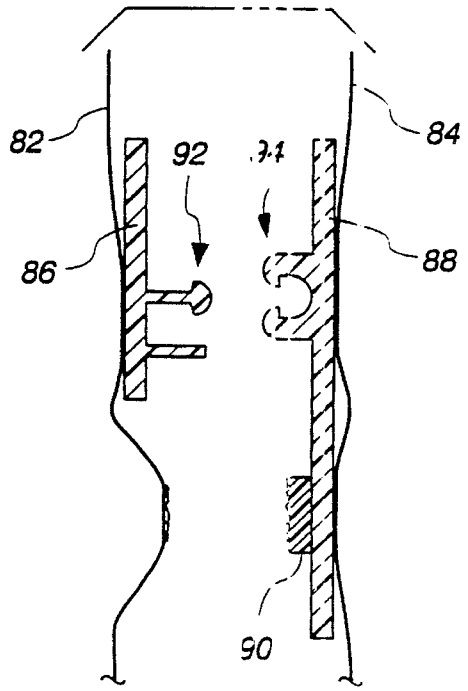
FIG. 6 is a sectional view of the closure arrangement in FIG. 5, showing the peelable seal after being broken.

In accordance with yet another embodiment of the present invention, FIGS. 5 and 6 illustrate a closure arrangement 80 for a polymeric bag having a top film 82 and a bottom film 84. The closure arrangement 80 includes a pair of flat opposing base strips 86, 88 and a flat peelable strip 90. In addition, the closure arrangement 80 may be provided with a reclosable zipper having interlocking male and female closure profiles 92, 94. The closure arrangement 80 is disposed at the mouth of the reclosable bag and extends along the length of the bag mouth. The top film 82 is heat-fused to both the base strip 86 and the peelable strip 90. To accommodate the peelable strip 90, the base strip 88 is wider, i.e., has a longer vertical dimension, than the base strip 86. Due to this relatively large width of the base strip 88, the bottom film 84 is heat-fused to the base strip 88 at multiple locations along its width so as to provide a firm attachment therebetween. If desired, instead of attaching the bottom film 84 directly to the base strip 88, a sealant strip composed of low-temperature sealant material may be interposed between the bottom film 84 and the base strip 88.

One surface of the peelable strip 90 is firmly attached to the inner surface of the base strip 88 by co-extruding the peelable strip 90 with the base strip 88. If desired, a sealant strip may be interposed between the peelable strip 90 and the base strip 88. This sealant strip, however, is not necessary to provide an effective bond between the peelable strip 90 and the base strip 88. As illustrated in FIG. 5, the opposite surface of the peelable strip 90 is attached to the top film 82 to form a peelable seal. In an alternative embodiment, the closure arrangement 80 includes additional peelable strips substantially identical to the peelable strip 90 and connected between the top film 82 and the base strip 88.

To manufacture the closure arrangement 80, the base strips 86, 88, the peelable strip 90, and the closure profiles 92, 94 are first co-extruded with each other through a single die plate. Alternatively, the base strip 86 and the male closure profile 92 may be extruded through one die plate, while the base strip 88, the peelable strip 90, and the female closure profile 94 are extruded through another die plate. As previously described, the top and bottom films 82, 84 are then fused, using heated seal bars, to the extruded elements to form the closure arrangement 80. As depicted in FIG. 6, the peelable seal between the peelable strip 90 and the top film 82 is broken by cutting open the bag mouth, disengaging the interlocked closure profiles 92, 94 from each other, and pulling the bag films 82, 84 is opposite directions.

A significant advantage of the closure arrangement 80 is that it facilitates control of the strength of the peelable seal formed between the top film 82 and the peelable strip 90. This control is due to the fact that the heat used to form the peelable seal only must penetrate through the top film 82, as opposed to the top film 82 along with other layers of material. By minimizing the layers of material through which the heat must penetrate to form the peelable seal, it is relatively easy to determine the required pressure, temperature, and dwell time of the heated seal bar in order to produce a peelable seal having a preferred strength ranging from two to six pounds per lineal inch. In addition, one or more of the foregoing three variables of the heated seal bar may be reduced to compensate for the shorter path of heat penetration associated with the closure arrangement 80.

Another related advantage of the closure arrangement 80 is that the peelable seal is located between the top film 82 and the peelable strip 90, as opposed to being located within multiple layers of material positioned between the top and bottom films 82, 84. By minimizing the number of material layers for forming the peelable seal, the closure arrangement 80 is both simple and effective.

Figure 7:
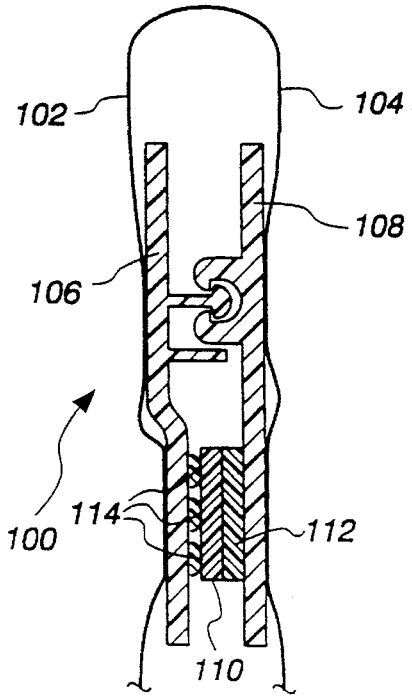
FIG. 7 is a sectional view of a closure arrangement of a further embodiment of the present invention, showing a peelable seal prior to being broken.
Figure 8:
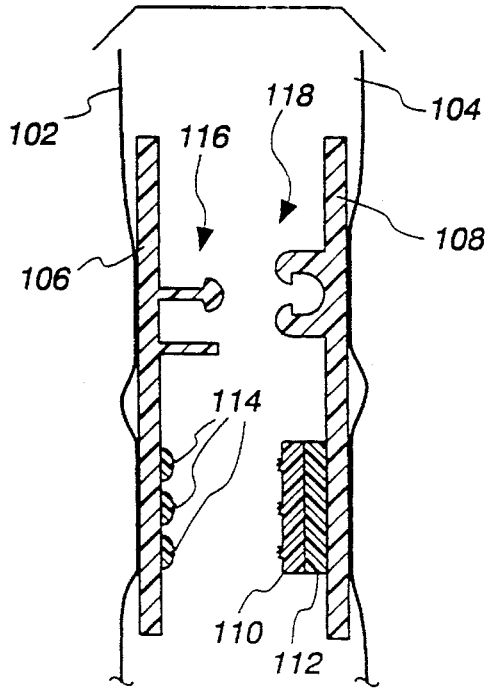
FIG. 8 is a sectional view of the closure arrangement in FIG. 7, showing the peelable seal after being broken.

In accordance with another embodiment of the present invention, FIGS. 7 and 8 illustrate a closure arrangement 100 for a polymeric bag having a top film 102 and a bottom film 104. The closure arrangement 100 includes a pair of flat opposing base strips 106, 108, a flat peelable strip 110, a flat sealant strip 112, and one or more sealant ribs 114. In the preferred embodiment, the closure arrangement 100 also includes a reclosable zipper having interlocking male and female closure profiles 116, 118. This reclosable zipper is substantially identical in structure and operation to the reclosable zipper described in connection with FIGS. 1 and 2.

The top and bottom films 102, 104 are firmly attached to the outer surfaces of the respective base strips 106, 108. The flat peelable strip 110 is firmly attached to the inner surface of the base strip 108 using the sealant strip 112. The sealant strip 112 provides a strong bond between the peelable strip 110 and the base strip 108 and insures that the peelable strip 110 remains attached to the base strip 108 following breakage of the peelable seals formed by the closure arrangement 100. Alternatively, however, the peelable strip 110 may be attached directly to the inner surface of the base strip 108.

The sealant ribs 114 are firmly attached to the inner surface of the base strip 106 and are detachably connected to the inner surface of the peelable strip 110 (FIG. 7). An individual peelable seal is formed between each of the sealant ribs 114 and the inner surface of the peelable strip 110 so as to form a combined peelable seal. Like the closure arrangement 50 in FIGS. 3 and 4, the closure arrangement 100 is designed to facilitate control of the strength of the combined peelable seal. The strength of the combined peelable seal is determined in part by the width of the sealant ribs 114 and the number of sealant ribs 114. The wider the sealant ribs 114, the stronger the individual peelable seals and, therefore, the stronger the combined peelable seal. To insure that breakage of the individual peelable seals occurs approximately at the locations shown in FIG. 8 and does not cause the peelable strip 110 to disengage from the sealant strip 112, it is preferred that the sealant ribs 114 be relatively narrow compared to the peelable strip 110.

The greater the number of sealant ribs 114, the stronger the combined peelable seal. Although FIGS. 7 and 8 illustrate the closure arrangement 100 as including three sealant ribs 114, the closure arrangement 100 may be modified to include as few as one sealant rib 114 or more than three sealant ribs 114. In the preferred embodiment, the combined peelable seal formed from the individual peelable seals has a strength ranging from two to six pounds per lineal inch.

The closure arrangement 100 is manufactured using conventional extrusion and heat sealing techniques. The base strips 106, 108, the peelable strip 110, the sealant strip 112, the sealant ribs 114, and the closure profiles 116, 118 are preferably co-extruded with each other using a single die plate. If desired, however, separate die plates may be employed to separately extrude the opposite sides of the closure arrangement 100. Using separate die plates, one die plate is used to extrude the base strip 106, the sealant ribs 114, and the male closure profile 116, and another die plate is used to extrude the base strip 108, the peelable strip 110, the sealant strip 112, and the female closure profile 118.

Following the foregoing extrusion operation, the top and bottom films 102, 104 are heat-fused to the respective base strips 106, 108 using heated seal bars. The heat from these seal bars penetrates through the closure arrangement 100 so as to simultaneously fuse the sealant ribs 114 to the peelable strip 110 and create the peelable seals therebetween. The pressure, temperature, and dwell time of the seal bars are adjusted such that the combined peelable seal has the preferred strength ranging from two to six pounds per lineal inch. A significant advantage of the closure arrangement 100 is that it has a relatively large manufacturing tolerance. Small variations in the pressure, temperature, or dwell time of the seal bars do not cause significant variations in the strength of the peelable seals. As a result, the closure arrangement 100 is relatively insusceptible to such manufacturing variations.

FIG. 7 illustrates the closure arrangement 100 prior to breaking the peelable seals, and FIG. 8 illustrates the closure arrangement after breaking the peelable seals. It can be seen from FIG. 8 that breaking the peelable seals causes the sealant ribs 114 to detach from the peelable strip 110. It should be understood that the closure arrangement 100 may be designed such that each of the sealant ribs 114 ruptures into two parts with one part remaining attached to the peelable strip 110 following breakage of the peelable seals. In this case, the peelable seals are located within the sealant ribs 114 themselves, as opposed to being located at the junction between the sealant ribs 114 and the peelable strip 110.

Figure 9:
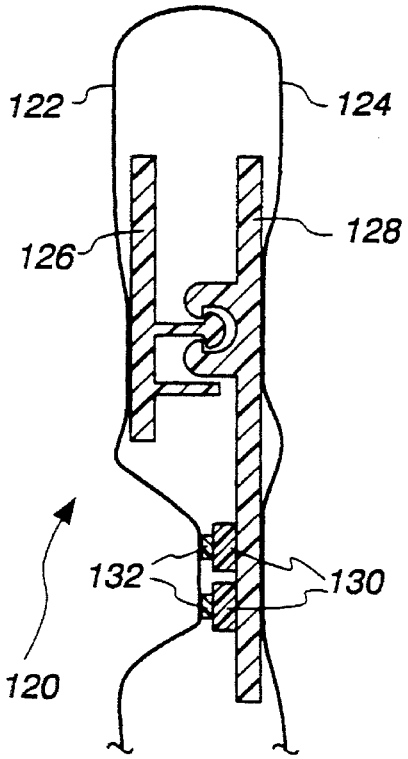
FIG. 9 is a sectional view of a closure arrangement of yet a further embodiment of the present invention, showing a peelable seal prior to being broken.
Figure 10:
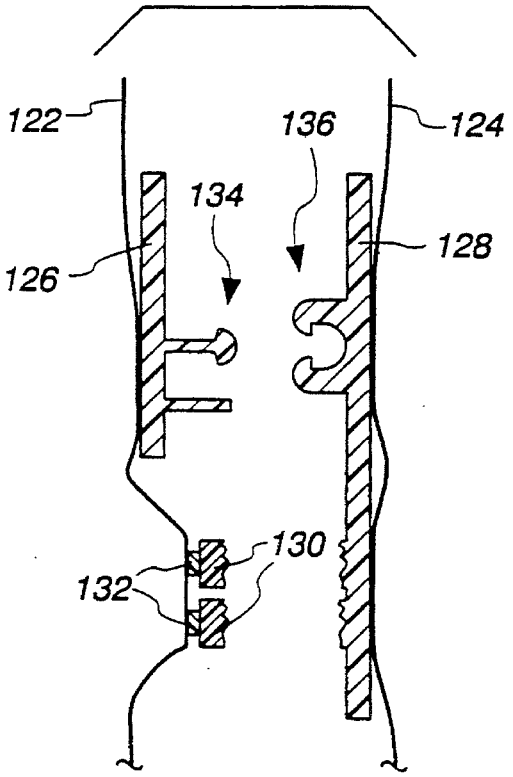
FIG. 10 is a sectional view of the closure arrangement in FIG. 9, showing the peelable seal after being broken.

In accordance with a further embodiment of the present invention, FIGS. 9 and 10 illustrate a closure arrangement 120 for a polymeric bag having a pair of opposing films 122, 124. The closure arrangement 120 includes a pair of opposing base strips 126, 128, a pair of adjacent peelable bands 130, and a pair of sealant bands 132. In the preferred embodiment, the closure arrangement 120 further includes interlocking male and female closure profiles 134, 136 integrally formed with the respective base strips 126, 128.

The films 122, 124 are firmly attached to the outer surfaces of the respective base strips 126, 128. The pair of peelable bands 130 are spaced a short distance from each other and are detachably connected to the inner surface of the base strip 128. These two connections between the peelable bands 130 and the inner surface of the base strip 128 form a pair of individual peelable seals. The pair of sealant bands 132, in turn, are firmly attached to both the inner surfaces of the pair of peelable bands 130 and the inner surface of the top film 122. The sealant bands 132 are narrower, i.e., have a smaller vertical dimension, than the peelable bands 130. To accommodate the connections between the sealant bands 132 and the top film 122, the base strip 126 has a shorter vertical dimension than the base strip 128. Therefore, an upper portion of the base strip 128 opposes the base strip 126, while a lower portion of the base strip 128 carrying the sealant bands 132 opposes the top film 122 without interference from the base strip 126.

The bond between the sealant bands 132 and the top film 122 and the bond between the sealant bands 132 and the peelable bands 130 are stronger than the bond between the peelable bands 130 and the base strip 128. As a result, the peelable seals are located between the peelable bands 130 and the base strip 128. When the two sides of the closure arrangement 120 are pulled apart, the bond between the peelable bands 130 and the base strip 128 breaks first, as illustrated in FIG. 10. The sealant bands 132 and the peelable bands 130 remain attached to the top film 122.

The closure arrangement 120 is designed to facilitate control of the strength of the combined peelable seal formed from the two individual peelable seals. The strength of the combined peelable seal is determined in part by the width of the peelable bands 130 and the number of peelable bands 130. The wider the peelable bands 130, the stronger the individual peelable seals and, therefore, the stronger the combined peelable seal. Furthermore, the greater the number of peelable bands 130, the stronger the combined peelable seal. Although FIGS. 9 and 10 illustrate the closure arrangement 120 as including a pair of peelable bands 130 and a pair of sealant bands 132 attached thereto, the closure arrangement 120 may be modified to include as few as one peelable band 130 with a sealant band 132 attached thereto or more than two peelable bands 130 with respective sealant bands 132 attached thereto. In the preferred embodiment, the combined peelable seal formed from the individual peelable seals has a strength ranging from two to six pounds per lineal inch.

The closure arrangement 120 is manufactured using conventional extrusion and heat sealing techniques. In particular, the pair of base strips 126, 128, the pair of peelable bands 130, the pair of sealant bands 132, and the interlocking closure profiles 134, 136 are co-extruded through a single die plate fed by a plurality of extruders. Alternatively, the base strip 126 and the male closure profile 134 are extruded through one die plate, and the base strip 128, the pair of peelable bands 130, the pair of sealant bands 132, and the female closure profile 136 are extruded through another die plate. Following this extrusion operation, the top and bottom films 122, 124 are fused using heated seal bars to the outer surfaces of the respective base strips 126, 128. Also, the top film 122 is fused to the sealant bands 132.

The preferred compositions of the various portions of the closure arrangements in FIGS. 1–10 are described below. More specifically, the peelable material used to form the peelable strips and bands in the closure arrangements is a mixture of four components. First, the peelable material includes a low density polyethylene such as Product No. 412FA manufactured by Westlake Polymers Corp. of Lake Charles, La. Second, the peelable material includes a mineral-reinforcement concentrate such as HM10 manufactured by Heritage Plastics Inc. of Picayune, Miss. Third, the peelable material includes ethylene vinyl acetate (EVA) such as ESCORENE® manufactured by Exxon Chemical Co. of Baytown, Tex. Finally, the peelable material includes polybutylene such as Shell 1560 manufactured by Shell Oil Co. of Houston, Tex. The weight percentages of the foregoing four components of the peelable material preferably are 30% low density polyethylene, 30% mineral-reinforcement concentrate, 20% ethylene vinyl acetate, and 20% polybutylene. The foregoing mixture allows the peelable material to achieve its desired characteristics, which include (1) the ability to provide a bond strength between two and six pounds per lineal inch, and (2) the ability to be heat sealed to another material using a heated seal bar having a temperature ranging from 300° F. to 400° F. and a dwell time ranging from 0.3 to 0.7 seconds.

The sealant material used to form the sealant strips, bands, and ribs in the closure arrangements is a mixture of low density polyethylene and ethylene vinyl acetate, such as VE 652059 manufactured by Quantum Chemical Corp. of Cincinnati, Ohio. This mixture allows the sealant material to seal at lower temperatures than low density polyethylene by providing the sealant material with a melting point ranging from 175° F. to 205° F.

The base material used to form the base strips is preferably composed of a mixture of two components. First, the base material includes a low density polyethylene such as Product No. 412FA manufactured by Westlake Polymers Corp. of Lake Charles, La. Second, the base material includes ethylene vinyl acetate such as ESCORENE® manufactured by Exxon Chemical Co. of Baytown, Tex. The preferred weight percentages are 90% low density polyethylene and 10% ethylene vinyl acetate. Alternatively, the base material may be composed of Rexene 1206 manufactured by Rexene Corporation of Odessa, Tex. The primary characteristics of the base material are that it bonds readily to both peelable material and sealant material and it provides a modicum of thermal resistance so that it does not melt while bonding other materials thereto.

The non-sealable material used to form the non-sealable strips of the closure arrangements in FIGS. 1–10 is a heat-resistant material such as polypropylene, nylon, or high density polyethylene.

The top and bottom films of the polymeric bags containing the closure arrangements are preferably composed of two or more layers of material. The outer layer of material is a heat-resistant material such as polyethylene terephthalate (PET), oriented polypropylene, or biaxially-oriented nylon. The inner layer of material is a sealant material such as a combination of low density polyethylene and ethylene vinyl acetate. A significant advantage of the closure arrangements in FIGS. 1–10 is that they do not form peelable seals within the bag film itself. Instead, the peelable seals are formed at some location between the top and bottom films. For example, in FIGS. 1–2, the peelable seal is located within the stem portion 34 of the peelable strip 24. The various layers of material from which the bag film is formed remain intact at all times. Since the peelable seals are not formed within the bag film, the bag film may be produced from relatively inexpensive materials, such as those described above.

During manufacture of the closure arrangements in FIGS. 1–10, the various bonds or attachments between different materials are formed such that the weakest bond is formed at the location of the peelable seal. By forming the weakest bond at the location of the peelable seal, the application of opening forces to the closure arrangement will cause the peelable seal to rupture first. Since the other bonds are stronger than the peelable seal, these other bonds will not rupture in response to the application of opening forces. As previously stated, the peelable seal in each of the closure arrangements preferably has a strength ranging from two to six pounds per lineal inch. This lineal inch is measured along the length of the peelable seal, i.e., perpendicular to the plane of the page in FIGS. 1–10 at the location of the peelable seal. The inventor has discovered that a peelable seal strength within this range allows the peelable seal to hermetically seal the associated bag and, at the same time, allows the peelable seal to be quickly and easily broken.

All other bonds between different materials, including those formed by extrusion and those formed by heat fusion, preferably have a strength of at least ten pounds per lineal inch. This difference in bond strength between the peelable seal and all other bonds insures that only the peelable seal will break in response to opening the closure arrangement.

Since the peelable seals of the closure arrangements in FIGS. 1–10 are relatively insusceptible to manufacturing variations, they are consistent in strength from one bag to the next. In addition, they break in a consistent manner from one bag to the next. To provide evidence of tampering, breaking the peelable seal of each of the closure arrangements causes the peelable seal to undergo a change in texture or appearance. This change in texture or appearance provides the consumer with a visual indication that the peelable seal has been broken.

While the present invention has been described with reference to several particular embodiments, those skilled in the art will recognize that many changes may be made thereto without departing from the spirit and scope of the present invention. For example, each of the closure arrangements may be modified either to remove the reclosable zipper or to position the reclosable zipper below, instead of above, the peelable seal. In the latter situation, the opposing pair of base strips of the closure arrangement are modified to include portions below the peelable seal onto which the closure profiles may be formed. The following claims set forth the scope of the present invention.

What is claimed is:

1. A closure arrangement for a polymeric bag having first and second opposing films, comprising:

first and second base strips disposed generally parallel to each other, each of said base strips having an inner and outer surface, said inner surfaces of said first and second base strips opposing each other and said outer surfaces of said first and second base strips being adapted for attachment to the respective first and second films;

first and second opposing peelable bands attached to the respective inner surfaces of said first and second base strips, said first and second peelable bands being detachably connected to each other to form a peelable seal therebetween;

a first heat-resistant strip attached to said inner surface of said first base strip and disposed adjacent to said first peelable band, said first heat-resistant strip including a projection; and a second heat-resistant strip attached to said inner surface of said second base strip, said second heat-resistant strip disposed adjacent to said second peelable band and opposite said first heat-resistant strip, said second heat-resistant strip including a notch sized to receive said projection.

2. The closure arrangement of claim 1, further including a third heat-resistant strip attached to said inner surface of said first base strip, said third heat-resistant strip disposed adjacent to said first peelable band on an opposite side of said first peelable band relative to said first heat-resistant strip, and further including a fourth heat-resistant strip attached to said inner surface of said second base strip, said fourth heat-resistant strip disposed adjacent to said second peelable band on an opposite side of said second peelable band relative to said second heat-resistant strip.

3. The closure arrangement of claim 1, wherein said first and second base strips include respective interlocking closure profiles attached thereto so that the bag is reclosable.

4. The closure arrangement of claim 3, wherein one of said interlocking closure profiles includes a pair of locking members and the other of said interlocking closure profiles includes a single locking member releasably engageable between said pair of locking members.

5. The closure arrangement of claim 1, wherein the depth of said notch is approximately equal to the depth of said second heat-resistant strip.

6. A closure arrangement for a polymeric bag having first and second opposing films, comprising:

first and second base strips disposed generally parallel to each other, each of said base strips having an inner and outer surface, said inner surfaces of said first and second base strips opposing each other and said outer surfaces of said first and second base strips being adapted for attachment to the respective first and second films;

a first plurality of peelable bands spaced away from each other and attached to the inner surface of said first base strip;

a second plurality of peelable bands attached to the inner surface of said second base strip and disposed opposite said first plurality of peelable bands, each of said second plurality of peelable bands being detachably connected to a respective one of said first plurality of peelable bands to form a plurality of peelable seals;

a first plurality of heat-resistant strips attached to said inner surface of said first base strip and separating said first plurality of peelable bands from each other, one of said first plurality of heat-resistant strips including a projection; and a second plurality of heat-resistant strips attached to said inner surface of said second base strip and separating said second plurality of peelable bands from each other, an associated one of said second plurality of heat-resistant strips opposing said one of said first plurality of heat-resistant strips and including a notch sized to receive said projection.

7. The closure arrangement of claim 6, wherein said first and second pluralities of peelable bands each include one peelable band, and wherein said first and second pluralities of heat-resistant strips each include a pair of heat-resistant strips disposed on opposite sides of the one peelable band.

8. The closure arrangement of claim 6, wherein said first and second pluralities of peelable bands each include a pair of peelable bands, and wherein said first and second pluralities of heat-resistant strips each include a first heat-resistant strip extending between the pair of peelable bands, a second heat-resistant strip disposed on an opposite side of one of the pair of peelable bands relative to the first heat-resistant strip, and a third heat-resistant strip disposed on an opposite side of the other of the pair of peelable bands relative to the first heat-resistant strip.

9. The closure arrangement of claim 6, wherein said first and second base strips include respective interlocking closure profiles attached thereto so that the bag is reclosable.

10. The closure arrangement of claim 9, wherein one of said interlocking closure profiles includes a pair of locking members and the other of said interlocking closure profiles includes a single locking member releasably engageable between said pair of locking members.

11. The closure arrangement of claim 1, wherein the depth of said notch is approximately equal to the depth of said associated one of said second plurality of heat-resistant strips.

12. A method of manufacturing a closure arrangement for a polymeric bag having first and second opposing films, comprising:

forming first and second base strips disposed generally parallel to each other, each of said base strips having an inner and outer surface, said inner surfaces of said first and second base strips opposing each other and said outer surfaces of said first and second base strips being adapted for attachment to the respective first and second films;

forming first and second opposing peelable bands and attaching said first and second peelable bands to the respective inner surfaces of said first and second base strips;

detachably connecting said first and second peelable bands to each other to form a peelable seal therebetween;

forming a first heat-resistant strip and attaching said first heat-resistant strip to said inner surface of said first base strip, said first heat-resistant strip disposed adjacent to said first peelable band and including a projection; and forming a second heat-resistant strip and attaching said second heat-resistant strip to said inner surface of said second base strip, said second heat-resistant strip disposed adjacent to said second peelable band and opposite said first heat-resistant strip, said second heat-resistant strip including a notch sized to receive said projection.

* * * * *